US006216861B1

(12) United States Patent
James et al.

(10) Patent No.: US 6,216,861 B1
(45) Date of Patent: Apr. 17, 2001

(54) PACK FOR SMOKING ARTICLES

(75) Inventors: Anthony George James; Colin Dennis Luton, both of Bristol; Rodney George Taylor, Woodhouse Eaves, all of (GB)

(73) Assignee: Imperial Tobacco Limited (GB)

( * ) Notice: Subject to any disclaimer, the term of this patent is extended or adjusted under 35 U.S.C. 154(b) by 0 days.

(21) Appl. No.: 09/423,082

(22) PCT Filed: May 1, 1998

(86) PCT No.: PCT/GB98/01283

§ 371 Date: Feb. 7, 2000

§ 102(e) Date: Feb. 7, 2000

(87) PCT Pub. No.: WO98/50288

PCT Pub. Date: Nov. 12, 1998

(30) Foreign Application Priority Data

May 3, 1997 (GB) ..... 9709020

(51) Int. Cl.[7] ..... B65D 85/10
(52) U.S. Cl. ..... 206/271; 206/273
(58) Field of Search ..... 206/242, 265, 206/268, 271, 273; 229/160.1, 123.2, 123.3

(56) References Cited

U.S. PATENT DOCUMENTS

| | | | | |
|---|---|---|---|---|
| 944,954 | * | 12/1909 | Davis | 206/268 |
| 2,202,279 | * | 5/1940 | Wilson | 206/268 |
| 2,940,590 | * | 6/1960 | Hook | 206/268 |
| 3,265,287 | * | 8/1966 | Hovland | 206/273 |
| 3,533,550 | * | 10/1970 | Benzon-Petersen | 206/273 |
| 5,143,282 | * | 9/1992 | Pham | 229/160.1 |
| 5,147,037 | * | 9/1992 | Evers et al. | 206/273 |
| 5,301,805 | * | 4/1994 | Evers et al. | 206/268 |

* cited by examiner

*Primary Examiner*—Luan K. Bui
(74) *Attorney, Agent, or Firm*—Larson & Taylor, PLC

(57) ABSTRACT

A pack (13) for elongate smoking articles encased in an inner wrapping includes a paperboard outer container having a generally rectangular base (14), four hingedly connected side walls (15–20) which upstand from the base, and a top panel member (22) which at least partially closes off the top of the pack. The side walls (15–20) are substantially the same height as the smoking articles and are secured with respect to the base. Access to the smoking articles is made beside the top panel member (22).

7 Claims, 4 Drawing Sheets

PACK FOR SMOKING ARTICLES

FIELD OF THE INVENTION

The present invention relates to packs for smoking articles which are elongate in appearance such as cigarettes.

BACKGROUND OF THE INVENTION

Packs for such smoking articles generally fall into one of three well known types. These are "hard" or "crushproof" packs having a hinged lid portion, "hull and slide" packs having an open ended outer hull in which the slide reciprocates and "soft" packs in which a foil bundle of smoking articles are covered in a paper wrapper which is open at its upper end. The "hard" and "soft" packs are much more popular than the rather old fashioned "hull and slide" packs and tend to appeal to different consumers for different reasons. "Soft" packs are less rigid than "hard" packs and tend to be less bulky after some of the contents have been used. This, however, can lead to damage to the remaining contents due to crushing of the flexible paper wrapper.

BRIEF SUMMARY OF THE INVENTION

According to the present invention there is provided a pack for elongate smoking articles encased in an inner wrapping, said pack comprising a paperboard outer container having a generally rectangular base, four hingedly connected side walls upstanding therefrom, and top panel means which at least partially closes off the top of the pack, said side walls being substantially the same height as the smoking articles and being secured with respect to the base, and access to the smoking articles being made by way of the top panel means.

Preferably said top panel means comprises a single top panel hingedly connected to one of said side walls and one or more securing panels hingedly connected to said top panel and adhesively secured to the inside of one or more of the other side walls. Ideally the top panel comprises a single thickness of paperboard. In some arrangements a single securing panel is provided and is adhesively secured to the side wall opposite said one side wall to which the top panel is connected. Normally said one side wall and said opposite side wall are wider than the other two side walls.

With certain embodiments the junctions between adjoining pairs of side walls are bevelled, either as radiussed bevels or as flat, angled bevels.

Another preferred feature is that the top panel extends wholly across the top of the pack and has a removable portion defined by lines of weakening such as perforations.

In one type of construction the base is hingedly connected at opposite edges to said one side wall and the opposite side wall, both of which side walls are each hingedly connected to oppositely disposed side wall portions, the side wall portions of said one side wall being adhesively secured to the respective side wall portions of the opposite side wall to produce the other two side walls.

With many embodiments the pack also incorporates a tax band which extends over the top panel means and which is secured thereto and to opposite side walls, said side walls being wider than the other two side walls.

BRIEF DESCRIPTION OF THE DRAWINGS

Embodiments of the invention will now be described in more detail making reference to the accompanying drawings in which.

DETAILED DESCRIPTION OF THE INVENTION

Figure 3:
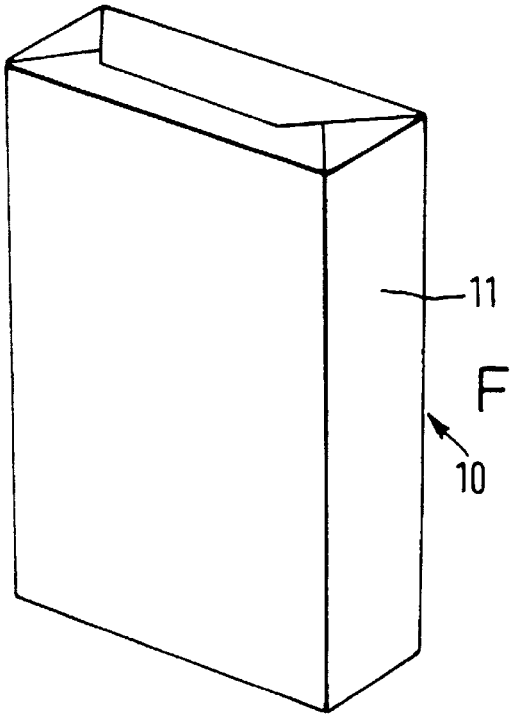
FIG. 3 is a perspective view of a foil wrapped bundle of smoking articles.

FIG. 3 shows a bundle 10 comprising a number of smoking articles, such as twenty cigarettes, wrapped in a folded inner wrapping 11. The wrapping 11 may be made of a thin, flexible material such as paper, metal foil or a metal coated paper. Such bundles are well known in the tobacco industry and only one example has been shown although other folding configurations are known for the wrapping 11.

Figure 1:
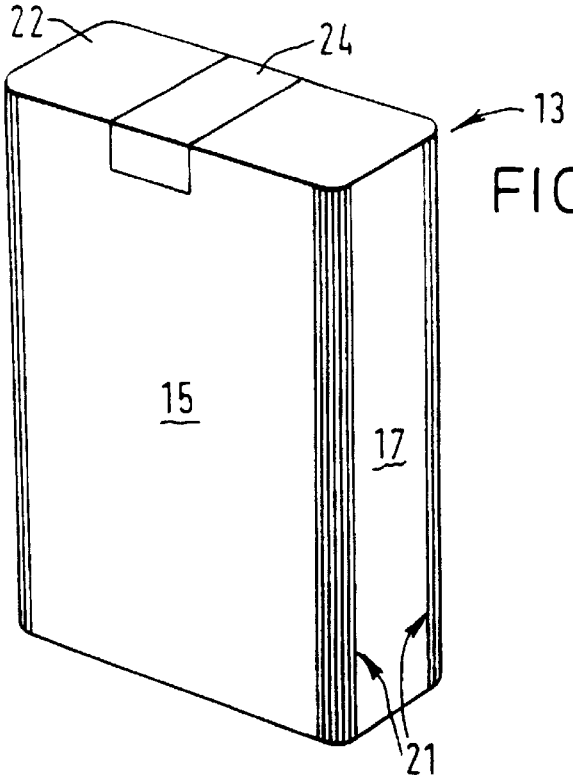
FIG. 1 is a perspective view of a pack according to the present invention.
Figure 2:
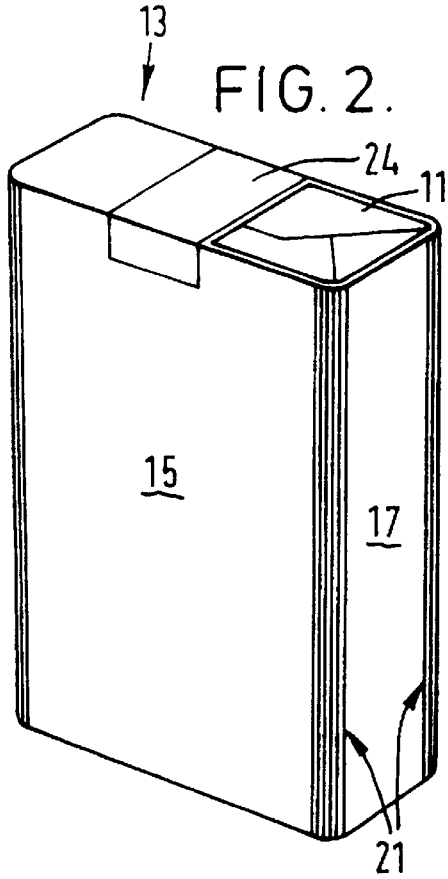
FIG. 2 is a perspective view of an alternative pack according to the present invention.
Figure 4:
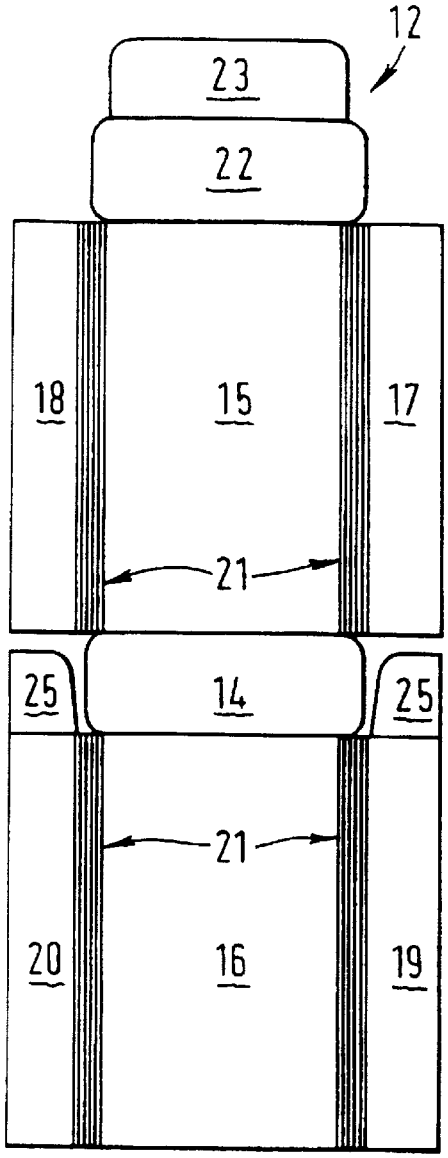
FIG. 4 shows a blank for encasing the FIG. 3 bundle to produce the pack shown in FIG. 1.

FIG. 4 shows a paperboard blank 12 for folding and securing about the bundle 10 to produce a pack 13 as shown in FIG. 1. The blank 12 has a base 14 which is hingedly connected on opposite sides to first and second main side walls 15, 16. The base 14 is generally rectangular with rounded corners. Hingedly connected at 21 to opposite lateral edges of the main side walls 15, 16 are side wall portions 17, 18, 19, 20. Each hinge connection 21 in this embodiment comprises a number of lengthwise creases, the purpose of which will become apparent in due course. Hingedly connected to the edge of the first main side wall 15 remote from the base 14 is a top panel 22 which in turn is hingedly connected to a securing panel 23. Tuck flaps 25 are also hingedly connected to the side wall portions 19, 20.

In one method of assembling the pack 13, the bundle 10 is placed on, and optionally adhesively secured to the first side wall 15. The top panel 22 is then folded up so as to lie against the top of the bundle 10 and the base 14 is also folded up so as to lie against the bottom of the bundle 10. The securing panel 23 is then folded over so as to lie against the bundle 10 and the second side wall 16 is folded down on to the bundle so as to be adhesively secured to the securing panel 23. The side wall portions 17–20 are then folded around the bundle whilst the tuck panels 25 are tucked between the bundle 10 and the base 14 and adjacent side wall portions 17, 19 and 18, 20 are adhesively secured to each other.

The lengthwise creases of each hinge connection 21 enable the blank 12 to curve around the bundle 10 which has a smoking article at each corner. In this way the finished pack 13 does not have sharp lengthwise edges but radiussed bevel edges which are matched in the top panel 22 and base 14.

It will be appreciated that other ways of folding and securing the blank are possible. Also, the hinge connections 21 could be in the form of small angled bevel panels defined between two lengthwise creases or could be single creases to produce sharper lengthwise edges. This applies to all described embodiments, with only minor modifications to the blank being necessary to produce the different pack effects.

At the same time as the side walls 15, 16 are being folded up, and the side wall portions are being secured, the top panel 22 and the securing panel 23 are being folded such that the securing panel 23 is adhesively secured to the inside of the second main side wall 16. In this configuration the top panel 22 extends over the top of the bundle. A band 24 which may be, for example, a tax band, may also be attached over the top of the top panel 22 from the first side wall to the second side wall 16. In other arrangements a band may extend from one pair of side portions 17, 19 across to the other pair of side portions 18, 20, covering the whole top area of the pack 13. Other types of tax band could also be used.

To gain access to the smoking articles, a portion of the top panel has to be removed to reveal the wrapping 11 of the bundle 10.

It will be appreciated that the pack 13 has many of the attributes of a "soft" pack with the paperboard sides giving the pack more rigidity against certain crushing forces. In addition the provision of a paperboard base and a top panel give the pack further rigidity against differently oriented crushing forces. However, the single thickness base and top do not reinforce the pack to the extent that it remains as rigid as a standard "hard" pack and this is an important feature to those consumers who tend to prefer the look and feel of "soft" packs. The pack 13 may also appeal to those consumers who tend to buy "hard" packs because the pack 13 is not as rigid as "hard" packs but retains its shape sufficiently to reduce damage to the contents when compared to standard "soft" packs.

Figure 5:
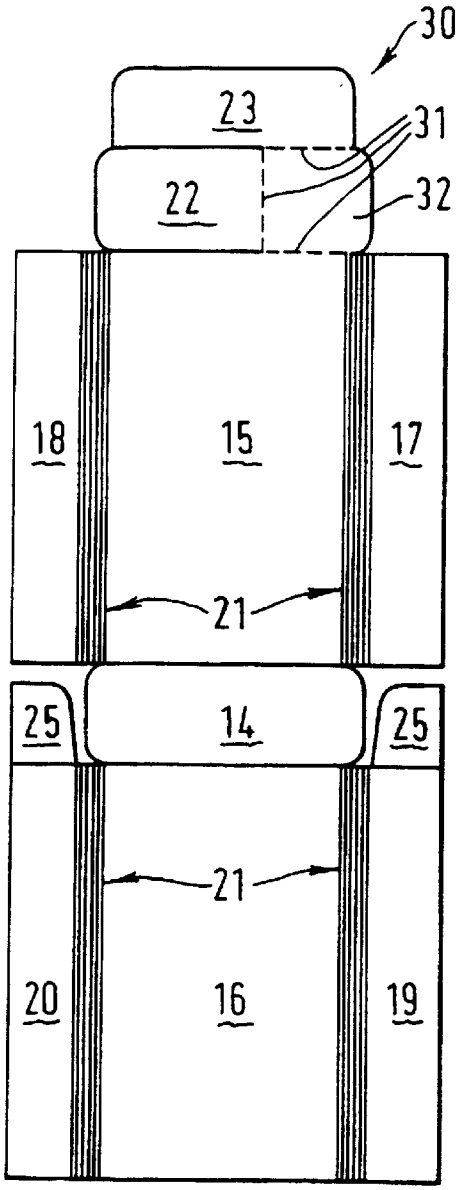
FIG. 5 shows a further blank for encasing the FIG. 3 bundle to produce a pack similar to FIG. 1.

FIG. 5 shows a very similar blank 30 to the blank 12 shown in FIG. 4. The only difference is that there are provided three perforated lines of weakening 31 to facilitate removal of a portion 32 of the top panel 22 to obtain access to the bundle 10.

Figure 6:
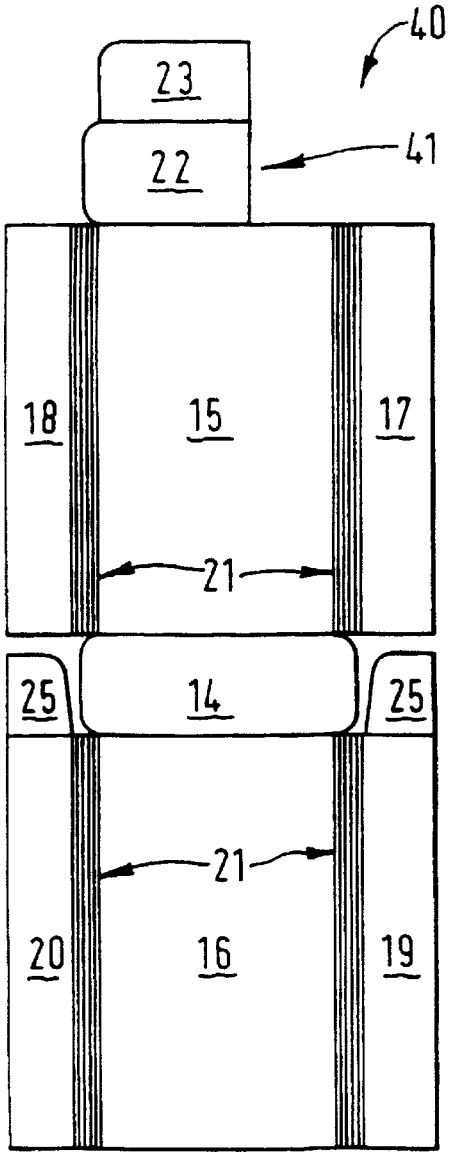
FIG. 6 shows a blank for encasing the FIG. 3 bundle to produce the pack shown in FIG. 2.

FIG. 6 shows another similar blank 40 to the blank 12 shown in FIG. 4 and like parts have been given similar reference numerals. The difference is that parts 41 of the top panel 22 and the securing panel 23 have already been removed such that the wrapping 11 of the bundle 10 is already visible. In practise the packs 13 of this and other embodiments will be overwrapped with a clear plastic film for added sealing and protection.

Figure 7:
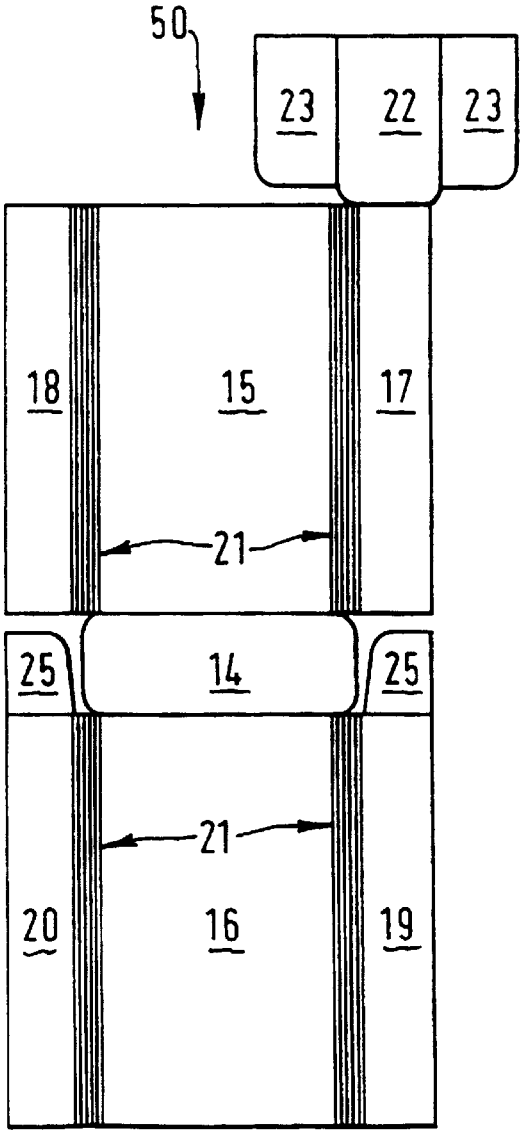
FIG. 7 shows a still further blank for encasing the FIG. 3 bundle to produce a further different pack.

In FIG. 7 there is shown a further blank 50 which is similar in many respects to the FIG. 4 blank 12 except that the top panel 22 is hingedly connected to one of the side panel portions 17 and has two securing panels 23 for attachment to respective main side walls 15, 16.

Figure 8:
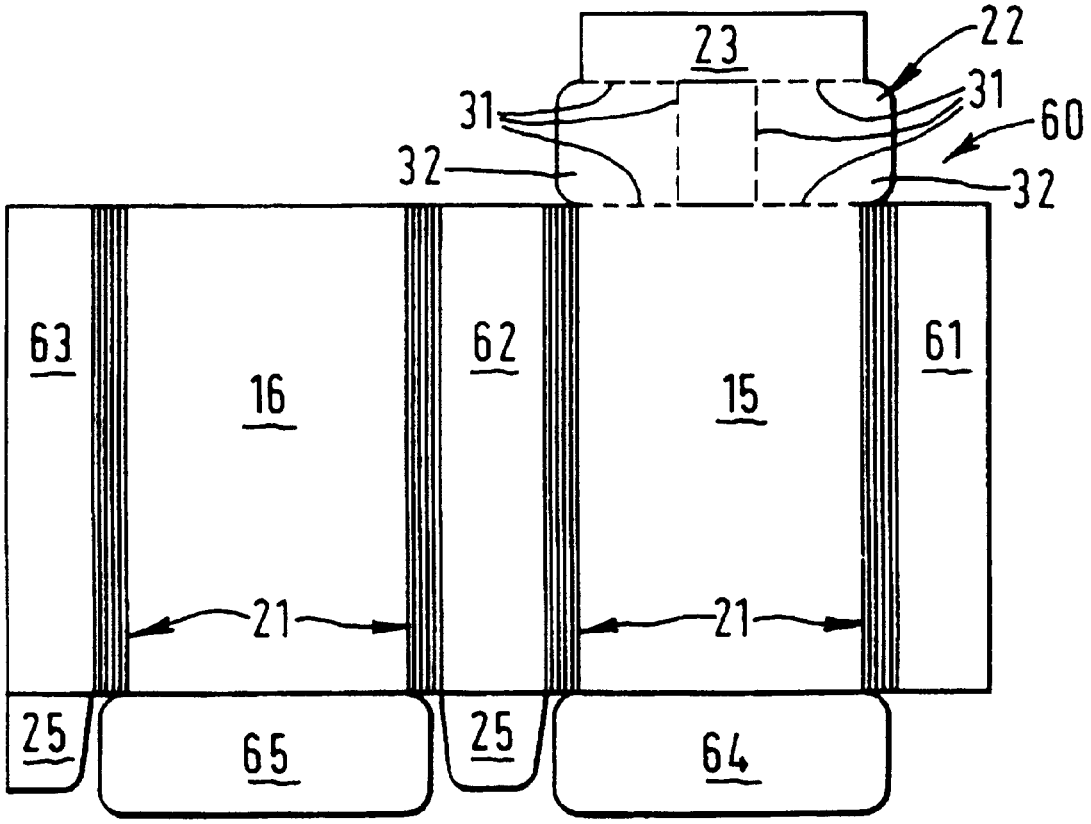
FIG. 8 shows an example of a differently oriented blank for producing a pack similar to FIG. 1.

FIG. 8 shows an alternative blank configuration 60 having a double set of perforations 31 in the top panel 22. Also the two main side walls 15, 16 are hingedly connected in series with three side wall portions 61, 62, 63 and each main side wall 15, 16 is hingedly connected to a base panel 64, 65. In one illustrative way of assembling the blank 60, the bundle 10 is placed on, and optionally adhered to, the first side wall 15. The top panel 22, base 64 and side wall portions 61, 62 are folded up against the bundle and then the securing panel 23 is folded down on to the side of the bundle 10. The second side wall 16 is then folded over the bundle and is secured to the securing panel 23. The other base panel 65 is then folded down and secured to the first base panel 64. Finally the side wall portion 63 is folded around and secured to side wall portion 61. During this assembly routine, the tuck panels 25 will be tucked above the base panels 64, 65.

The double thickness base gives more rigidity at the base compared to the top. With filter cigarettes the filters tend to be at the top and so the extra base rigidity can reduce damage to the other, tobacco containing ends of the filter cigarettes.

Similar alternative blank configurations could of course be utilised in place of the other blanks described above. In other arrangements the securing panel or panels may not be glued but may be simply tucked inside the main side walls or may even be glued to the outside of the main side panels. Also, in the FIGS. 5 and 6 blanks the portion to be removed or the removed portion need not be rectangular as shown but could be any desired shape. Also there may be a further removable portion on the other lateral side of the top panel.

What is claimed is:

1. A pack which contains elongate smoking articles encased in an inner wrapping, said pack comprising:

a paperboard outer container having a generally rectangular base, four hingedly connected side walls upstanding from said base and extending uninterruptedly to a top of the pack, and a top panel member which, when the pack is formed, only partially closes off the top of the pack, said top panel member comprising a single top panel hingedly connected to one of said side walls and one or more securing panels hingedly connected to said top panel an adhesively secured to an inside of one or more of said side walls; and wherein said side walls are a predetermined height which is selected to be substantially a same predetermined height as the smoking articles and are secured with respect to the base;

wherein access to the smoking articles is made beside the top panel member; and wherein a junction between adjoining pairs of side walls is contoured.

2. A pack as claimed in claim 1, wherein the top panel comprises a single thickness of paperboard.

3. A pack as claimed in claim 1, wherein a single securing panel is provided which is adhesively secured to a said side wall opposite to said one side wall to which the top panel is connected.

4. A pack as claimed in claim 3, wherein said one side wall and said opposite side wall are wider than the other two said side walls.

5. A pack as claimed in claim 1, wherein the base is hingedly connected at opposite edges to said one side wall and to said opposite side wall, both of which said side walls are each hingedly connected to oppositely disposed side wall portions, the side wall portions of said one side wall being adhesively secured to respective side wall portions of said opposite side wall to produce the other two said side walls.

6. A pack as claimed in claim 1, further including a band which extends over the top panel member and which is secured thereto and to opposite said side walls, said opposite side walls being wider than the other two said side walls.

7. A pack which contains elongate smoking articles encased in an inner wrapping, said pack comprising:

a paperboard outer container having a generally rectangular base, four hingedly connected side walls upstanding from said base and extending uninterruptedly to a top of the pack, a top panel member which, when the pack is formed, only partially closes off the top of the pack;

a band which extends over the top panel member and which is secured thereto and to opposite said side walls, said opposite side walls being wider than the other two said side walls; and wherein said side walls are a predetermined height which is selected to be substantially a same predetermined height as the smoking articles and are secured with respect to the base;

wherein access to the smoking articles is made beside the top panel member; and wherein a junction between adjoining pairs of side walls is contoured.

* * * * *